US006162992A

United States Patent [19]

Clark et al.

[11] Patent Number: 6,162,992

[45] Date of Patent: Dec. 19, 2000

[54] SHIFTED-PLANE CORE GEOMETRY CABLE

[75] Inventors: William Clark, Lancaster; Joseph Dellagala, Shrewsbury; Kenneth Consalvo, Leominster, all of Mass.

[73] Assignee: Cable Design Technologies, Inc., Leominster, Mass.

[21] Appl. No.: 09/274,890

[22] Filed: Mar. 23, 1999

[51] Int. Cl.[7] ..... H01B 11/02

[52] U.S. Cl. ..... 174/113 R; 174/113 C; 174/115

[58] Field of Search ..... 174/113 R, 113 C, 174/131 A, 115, 117 R, 117 F

[56] References Cited

U.S. PATENT DOCUMENTS

| | | | |
|---|---|---|---|
| 867,659 | 10/1907 | Hoopes et al. | 174/115 X |
| 1,883,269 | 10/1932 | Yonkers . | |
| 2,218,830 | 10/1940 | Rose et al. | 174/115 X |
| 3,328,510 | 6/1967 | White | 174/115 X |
| 4,319,940 | 3/1982 | Arrovo et al. . | |
| 4,487,992 | 12/1984 | Tomita . | |
| 4,500,748 | 2/1985 | Klein . | |
| 4,595,793 | 6/1986 | Arrovo et al. . | |
| 4,605,818 | 8/1986 | Arrovo et al. . | |
| 4,644,098 | 2/1987 | Norris et al. | 174/113 R X |
| 4,697,051 | 9/1987 | Beggs et al. . | |
| 4,777,325 | 10/1988 | Siwinski . | |
| 4,847,443 | 7/1989 | Basconi | 174/115 X |
| 4,892,683 | 1/1990 | Naseem | 174/113 R X |
| 5,132,488 | 7/1992 | Tessier et al. | 174/113 R X |
| 5,155,304 | 10/1992 | Gossett et al. | 174/117 R |
| 5,253,317 | 10/1993 | Allen et al. . | |
| 5,298,680 | 3/1994 | Kenny . | |
| 5,399,813 | 3/1995 | McNeill et al. . | |
| 5,424,491 | 6/1995 | Walling . | |
| 5,444,184 | 8/1995 | Hassel | 174/113 R |
| 5,493,071 | 2/1996 | Newmover . | |
| 5,514,837 | 5/1996 | Kenny et al. . | |
| 5,821,467 | 10/1998 | O'Brien et al. | 174/117 F |
| 5,936,205 | 8/1999 | Newmoyer | 174/113 R |
| 5,969,295 | 10/1999 | Boucino et al. | 174/113 C |

*Primary Examiner*—Kristine Kincaid
*Assistant Examiner*—Chau N. Nguyen
*Attorney, Agent, or Firm*—Wolf, Greenfield & Sacks, P.C.

[57] ABSTRACT

A telecommunications cable is disclosed in which a plurality of inwardly extending projections from the cable jacket, form a first and second plurality of substantially parallel longitudinal channels within the cable jacket. The first and second plurality of longitudinal channels are spaced apart from one another with respect to a reference line that transverses the cable, wherein the plurality of inwardly extending projections provide the spaced apart distance between the first plurality and the second plurality of longitudinally extending channels and between corresponding transmission media disposed within the first and second plurality of longitudinally extending channels. With this arrangement, cross talk between the transmission media within the cable is reduced and alien crosstalk between adjacently disposed or stacked cables is also reduced.

41 Claims, 10 Drawing Sheets

SHIFTED-PLANE CORE GEOMETRY CABLE

BACKGROUND OF THE INVENTION

1. Field of the Invention

The present invention relates to high-speed data communications cables containing a plurality of transmission media. More particularly it relates to cables having a cable jacket in which each of the plurality of transmission media is separated from the other transmission media, by a plurality of channels, where adjacent channels are offset from one another to increase the distance between the respective transmission media within the adjacent channels, thereby reducing the level of coupling of cross-talk signal interference between the transmission media within the cable jacket.

2. Related Art

High speed data communications cables in current use include pairs of wire twisted together forming a balanced transmission line. Such pairs of wire are referred to as twisted pairs.

One common type of conventional cable for high-speed data communications includes multiple twisted pairs. In each pair, the wires are twisted together in a helical fashion forming a balanced transmission line. When twisted pairs are placed in close proximity, such as in a cable, electrical energy may be transferred from one pair of the cable to another. Such energy transfer between pairs is undesirable and is referred to as crosstalk. Crosstalk causes interference to the information being transmitted through the twisted pair and can reduce the data transmission rate and can cause an increase in the bit error rate. The Telecommunications Industry Association (TIA) and Electronics Industry Association (EIA) have defined standards for crosstalk in a data communications cable including: TIA/EIA-568-A, published Oct. 24, 1995; TIA/EIA 568-A-1published Sep. 25, 1997; and TIA/EIA 568-A-2, published Aug. 14, 1998. The International Electrotechnical Commission (IEC) has also defined standards for data communications cable crosstalk, including ISO/IEC 11801 that is the international equivalent to TIA/EIA 568-A. One high performance standard for data communications cable is ISO/IEC 11801, Category 5.

In twisted pairs, the length of a complete twist between the twisted pairs is known as the twist lay. The direction of the twist is known as the twist direction. If adjacent twisted pairs have the same twist lay and/or twist direction, they will tend to lie more closely together within a cable than if they have different twist lays and/or twist directions. Thus, compared to twisted pairs having different twist lays and/or twist directions, adjacent twisted pairs having the same twist lay and twist direction have a reduced center-to-center distance, and longer parallel run. Therefore, the level of crosstalk tends to be higher between the twisted pairs having the same twist lay and/or twist direction when compared to other twisted pairs having different twist lays and/or twist directions. Therefore, twisted pairs within a cable are sometimes given unique twist lays and twist directions when compared to other adjacent twisted pairs within the cable. The unique twist lay and twist direction serve to decrease the level of crosstalk between the adjacent twisted pairs within the cable.

Shielded cable, although exhibiting better crosstalk isolation, is more difficult and time consuming to install and terminate and is therefore more expensive per installation. Shielded conductors are generally terminated using special tools, devices and techniques adapted for the job.

One popular cable type is Unshielded Twisted Pair (UTP) cable. Because it does not include shielded conductors, UTP cable is preferred by installers and plant managers, as it is easily installed and terminated. However, UTP cable typically fails to achieve the level crosstalk isolation required by state of the art transmission systems, even when varying pair lays and twist directions are used.

Another crosstalk requirement known as "alien crosstalk" is the amount of signal coupling or interference between adjacent or stacked cables. In particular, when the cable are adjacently disposed or disposed one on top of another, there is typically crosstalk between the twisted pairs in each cable. For example, in adjacently disposed cables having a substantially flat configuration, the twisted pairs disposed at one end of each adjacently disposed cable will be in close proximity and will tend to have alien crosstalk that may not be acceptable for state of the art transmission systems.

What is needed therefore is a high-speed data communications cable having a reduced level of cross-talk interference between adjacent twisted pairs within the cable and having a reduced level of alien crosstalk between the twisted pairs in adjacent or stacked cables.

SUMMARY OF THE INVENTION

The present invention provides a data cable having a lower value of cross-talk between adjacent twisted pairs within a cable and a higher level of isolation when compared to conventional cables. In addition, the cable has a lower value of alien crosstalk between similar adjacently disposed or stacked cables of the invention. These and other advantages are accomplished by the disclosed cable arrangements.

According to one embodiment, a data communications cable includes a cable jacket having a plurality of inwardly extending projections defining three longitudinal channels within the cable extending along a length of the telecommunications cable. Each longitudinal channel contains at least one transmission medium. Two of the longitudinal channels are disposed at approximately a same point with respect to a reference line that transverses the cable, the second longitudinal channel is spaced apart from the references line by one of the plurality of inwardly extending projections, thus, increasing a center-to-center distance between the transmission media in adjacent longitudinal channels.

The inwardly extending projection may also be tacked together to seal each of the longitudinal channels. Alternatively, some of the plurality of inwardly extending projections may be tacked together to isolate some of the channels.

The telecommunications cable may also be formed with a desired form factor ratio of a width of the cable to a height of the cable over a range between 1.25 and 2.5. Preferably, the telecommunications cable has a form factor ratio in the range of 1.5 to 2.0.

The cable jacket may also be formed with a number of different arrangements to increase a center-to-center distance of stacked cables. In one embodiment, the jacket may be formed with different thicknesses on different portions of the cable jacket. In an alternative embodiment, the cable jacket may be formed with outwardly extending protrusions.

Another embodiment of the telecommunications cable includes a cable jacket formed having a plurality of inwardly extending projections defining a first and second plurality of substantially parallel longitudinal channels within the cable. Each longitudinal channel contains at least one transmission medium. The first plurality of substantially parallel longitudinal channels are at approximately the same point with respect to a reference line that transverses the cable. The second plurality of substantially parallel longitudinal channels are spaced apart from the reference line by some of the inwardly extending projections. Thus, the corresponding transmission media within the first plurality of channels is spaced apart from the corresponding transmission media in the second plurality of channels.

A method for manufacturing a cable corresponding to the invention includes providing a cable jacket having inwardly extending projections, extending from an inner surface of the cable jacket and having inner ends that define a plurality of substantially parallel longitudinal channels within the cable jacket, with adjacent longitudinal channels being offset from one another. Passing a plurality of twisted pairs of insulated conductors through a die which aligns the plurality of twisted pairs of insulated conductors in a predetermined spatial relationship. Inserting each of the plurality of twisted pairs of insulated conductors within a corresponding one of the plurality of longitudinal channels.

The step of providing the cable jacket may also include extruding the cable jacket with opposing edges of the ends of each of the inwardly extending projections tacked together. Alternatively, the cable jacket may be extruded with at least one opposing edge of an end of two of the inwardly extending projections being tacked together.

The step of providing the cable jacket may also include extruding the cable jacket with a form factor ration of a width of the jacket to a height of the jacket in a range between 1.25 and 2.5. Preferably the cable jacket is extruded with a form factor ratio between 1.5 and 2.0.

The step of providing the cable jacket may also include extruding the cable jacket with any of outwardly extending projections and having different thicknesses for different portions of the cable jacket, so that stacked cables have reduced alien crosstalk.

BRIEF DESCRIPTION OF THE DRAWINGS

This invention is pointed out with particularity in the appended claims. The above and further advantages of this invention may be better understood by referring to the following description when taken in conjunction with the accompanying drawings, in which:

DETAILED DESCRIPTION OF THE DRAWINGS

A telecommunications cable having a lower level of coupling of electromagnetic fields between adjacent twisted pairs within a cable as compared to conventional UTP cable is disclosed. This lower level of coupling of electromagnetic fields between adjacent twisted pairs leads to a lower level of crosstalk interference of the twisted pairs. The telecommunications cable of the invention achieves this improvement by forming a plurality of longitudinal channels within the cable jacket of the cable, where adjacent longitudinal channels are offset from one another.

The following embodiments of the data communications cable are now described with a cable illustrated to include four twisted pairs of wire. However, the invention is not limited to a cable having the number of pairs disclosed. The data communications cable according to the invention can include a greater for fewer numbers of twisted pairs. Also, although the data communications cable is described and illustrated in connection with twisted pair data communication media, other high-speed data communication media can be used in a cable according to the present invention.

Crosstalk is primarily capacitively coupled or inductively coupled energy passing between adjacent twisted pairs within a cable. Among the factors that determine the amount of crosstalk between the wires in adjacent twisted pairs, the center-to-center distance between the wires in the adjacent twisted pairs is very important. The center-to-center distance is defined herein to be the distance between the center of one twisted pair to the center of another adjacent twisted pair. The magnitude of both capacitively coupled and inductively coupled crosstalk is inversely proportional to the center-to-center distance between the twisted pairs of wires. Increasing the distance between the twisted pairs reduces the level of signals coupled between adjacent twisted pairs, and reduces crosstalk interference between the adjacent twisted pairs. Another important factor relating to the level of crosstalk is the distance over which the wires run parallel to each other. Twisted pairs that have longer parallel runs will have higher levels of coupling of crosstalk generating signals occurring between them.

The illustrative embodiments of the telecommunications cable, as shown in FIGS. 1 through 10, are illustrated as having four twisted pairs of conductors. It should be obvious to one of ordinary skill in the art that the inventive concept can be used in cables having three or more twisted pairs of conductors and that the invention is not limited to the embodiments illustrated in the figures.

Figure 1:
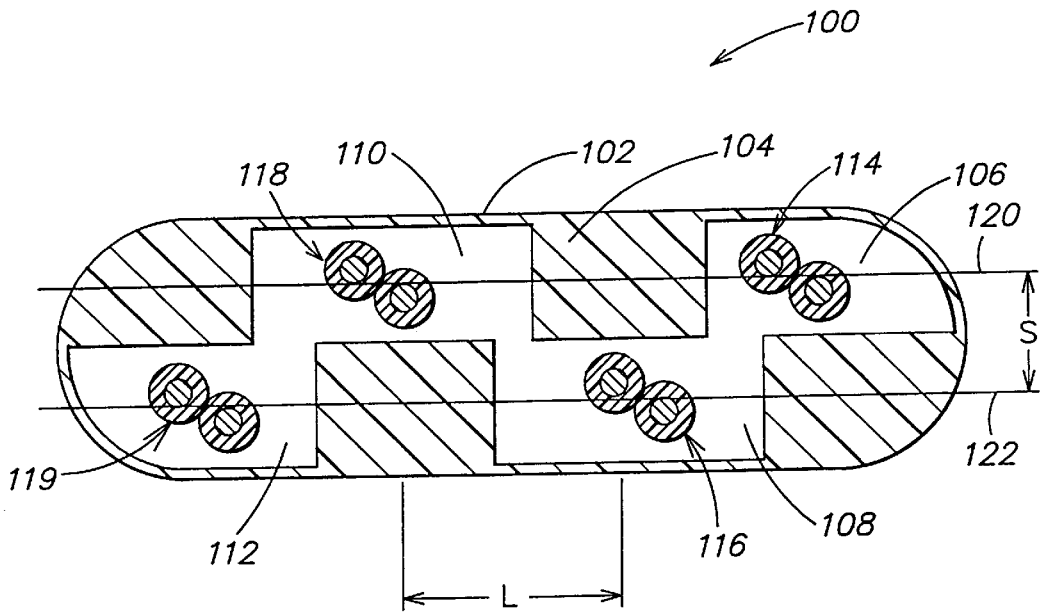
FIG. 1 is a cross-sectional view of a cable of one embodiment of the invention.

FIG. 1 illustrates one embodiment of the telecommunications cable 100 that includes a cable jacket 102 and inwardly extending protrusions 104, that define four longitudinal channels 106, 108, 110, 112. In the illustrative embodiment shown in FIG. 1, a first axis 120 of the cable formed by some of the inwardly extending protrusions and a second axis 122 formed by the remainder of the inwardly extending protrusions are substantially parallel and spaced apart from each other by a distance "S". Compared to a conventional cable in which all the twisted pairs 114, 116, 118 and 119 are co-planar, the center-to-center distance in the telecommunications cable 100 of the invention is increased from a linear distance "L" to the distance $\sqrt{(L^2+S^2)}$. This increase in the center-to-center distance between adjacent twisted pairs within the cable will concomitantly decrease the coupling of signals between adjacent twisted pairs, thus reducing the crosstalk interference.

Advantageously, the embodiment of the cable of the invention shown in FIG. 1, also has a user-friendly form factor. It is to be appreciated that according to the application, user-friendly form factor is defined to be a cable that is relatively easy to install, to install around corners, and to mate with standard connectors. A form factor ratio is also herein defined as the ratio of the width of the cable to the height of the cable, and can be used to define the "roundness" of a cable. A cable having a form factor of 1 is a round cable. As the ratio increases the cable becomes flatter. According to the cables of the invention, the form factor ratio range is preferably between 1.25 and 2.5, with a more preferred form factor ratio range of between 1.5 and 2.0.

It will be obvious to one of ordinary skill in the art that there are many possible configurations of the inwardly extending projections that could be used to define the longitudinal channels according to the invention. An important aspect of the telecommunications cable of the invention is that inwardly extending projections be sized and configured to prevent the inadvertent migration of a twisted pair form one longitudinal channel into an adjacent longitudinal channel. Having two of the twisted pairs in one longitudinal channel would result in a degradation of performance of the affected twisted pairs of conductors.

Figure 2:
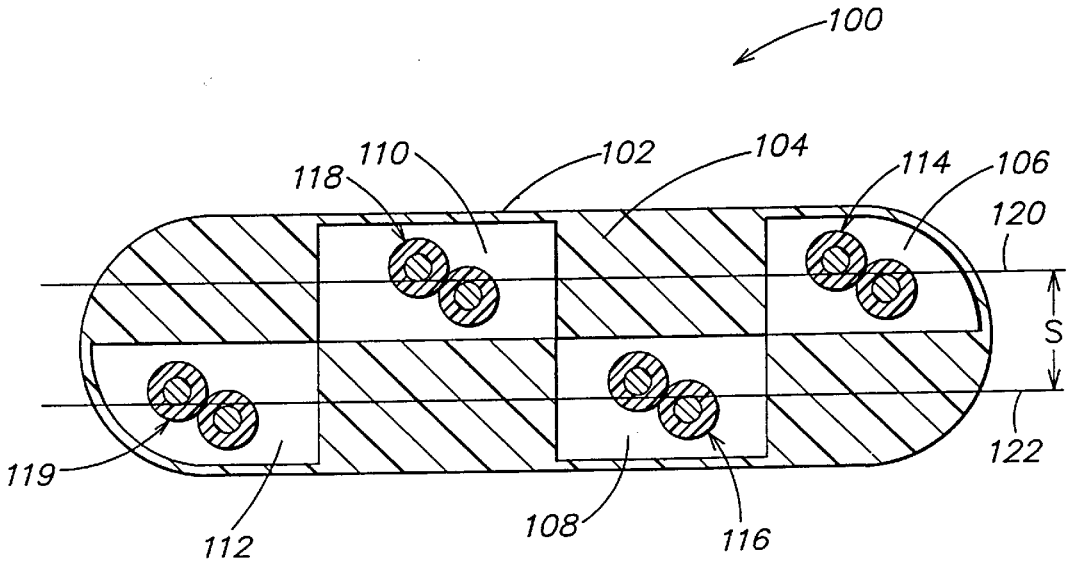
FIG. 2 is a cross-sectional view of an alternate embodiment of the cable of FIG. 1.

In one embodiment illustrated in FIG. 2 wherein like reference numbers are used for common elements of FIG. 1, each of the opposing inwardly extending projections 104 can be "tacked" together. By tacked, it is to be understood that the corners of opposing inwardly extending projections are fused together either by fusing the corners together after they have been formed, or by extruding the jacket with the corners of the inwardly extending projections already fused together, or by another manner known to one of skill in the art. Advantageously this not only prevents the migration of twisted pairs from one longitudinal channel into another, but also provides increased physical stability of the cable as well. In an alternate embodiment (not illustrated), only the center inwardly extending projections can be tacked together.

Another advantage of the cable of the invention is that the inwardly extending projections can also inherently provide additional strain relief when mating with a connector, such as an RJ45 connector. Because the inwardly extending projections can also act as padding, the projections can limit the amount of compression of the cable, by, for example, the push bar of the RJ45 connector, and may also reduce any tension stress on the twisted pairs. This may also result in a more secure connection.

Figure 3:
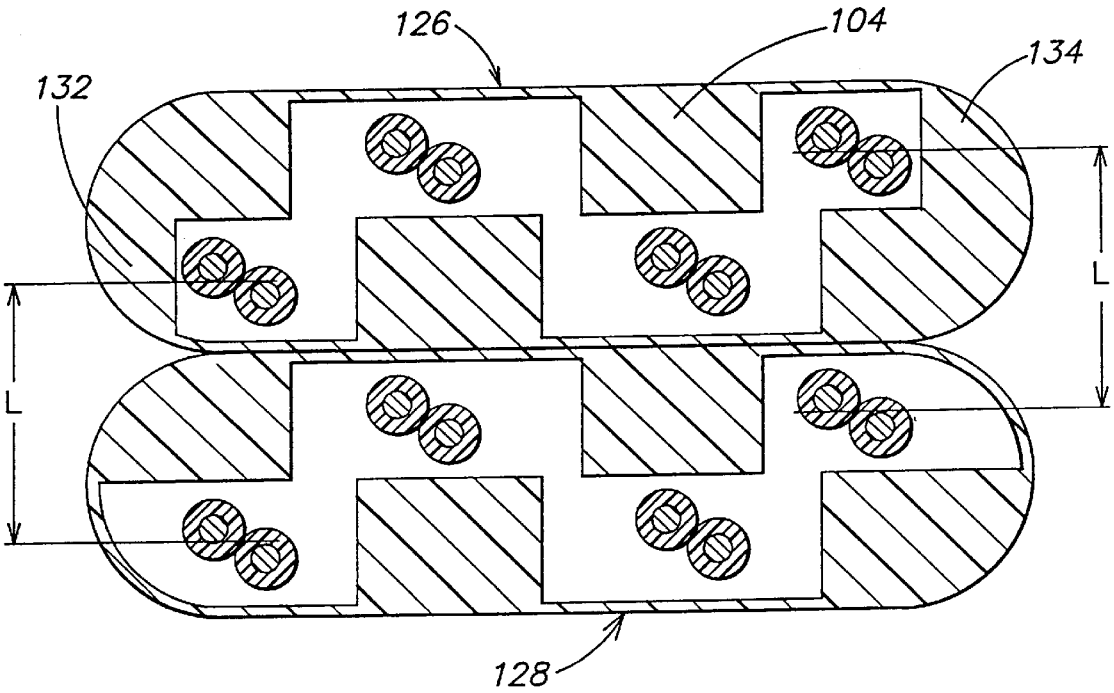
FIG. 3 is a cross-sectional view of a plurality of cables of the invention stacked together.

It is to be appreciated that the cable of the invention is not limited to the disclosed configuration but is applicable to other configurations that provide adjacent twisted pairs that are offset from one another. FIG. 3 shows two cables 126 and 128 of the cable of FIG. 1, disposed in a linear stacking arrangement. An advantage of the cable of the invention is that it provides a center-to-center distance "L" of twisted pairs in adjacent cables, which is an increase in the center-to-center distance when compared to a conventional flat cable. In addition, FIG. 3 illustrates an alternative embodiment of the cable 126, in which the inwardly extending protrusions 104 have additional regions 132 and 134 that increase the center-to-center distance between twisted pairs in adjacent disposed cables as well. Therefore, an advantage of the cable of the invention is that like adjacently disposed or stacked cables will have reduced alien crosstalk between them.

Figure 4:
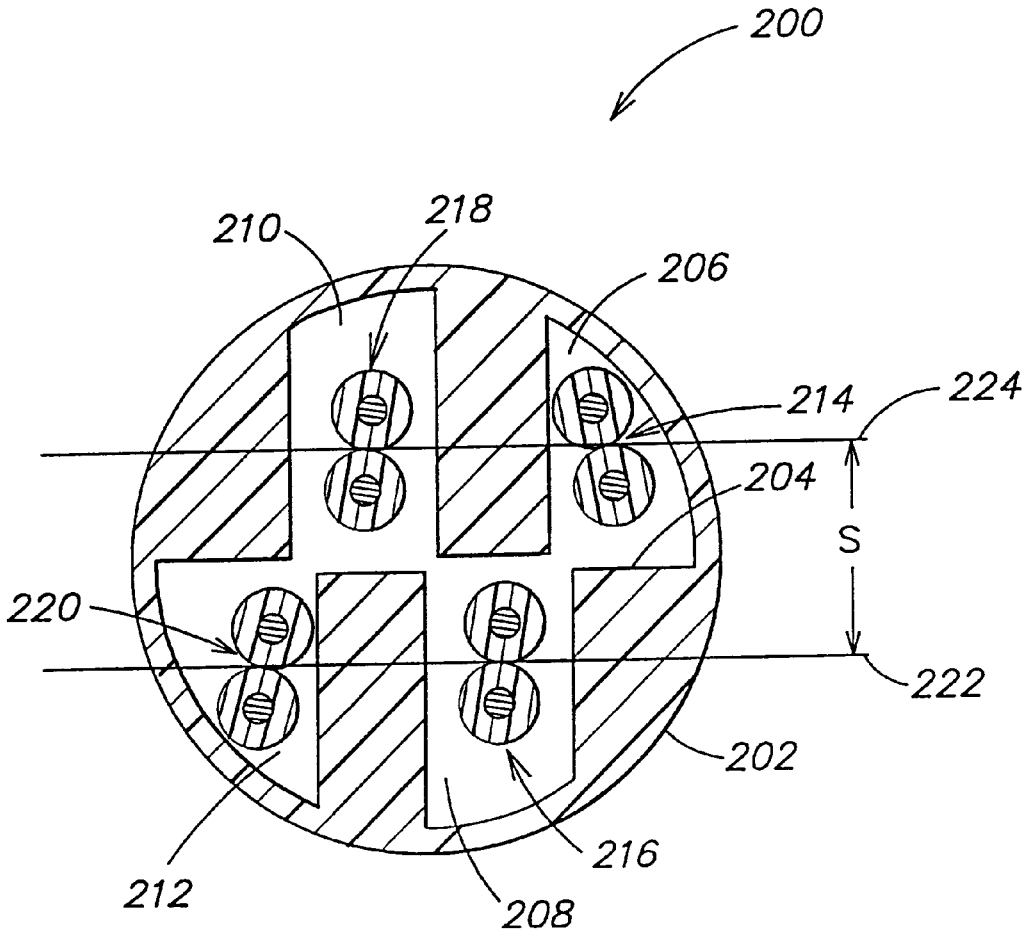
FIG. 4 is a cross-sectional view of a cable of another embodiment of the invention.

FIG. 4 shows another embodiment of a telecommunications cable 200 in which the cable jacket has a substantially circular cross section. Cable jacket 202 has four inwardly extending projections 204 that extend from an inner surface of the cable jacket into the center of the cable jacket forming four longitudinal channels 206, 208, 210 and 212. Each longitudinal channel 206–212 has an associated twisted pair of conductors 214, 216, 218 and 220, respectively disposed within the corresponding longitudinal channels 206–212. As noted above, the inwardly extending projections should be sized and configured to prevent the inadvertent migration of a twisted pair form one longitudinal channel into an adjacent longitudinal channel. Having two of the twisted pairs of conductors in one longitudinal channel would result in a degradation of performance of the twisted pairs of conductors and of the cable. Two of the longitudinal channels 208 and 212 are substantially at a first axis 222 of the cable and a second pair of longitudinal channels 206 and 210 are substantially at a second axis 224 of the cable. The first and second axis 220 and 222 respectively are spaced apart by a distance "S". As described above, this distance S will increase the center-to-center distance between adjacent twisted pairs of conductors and concomitantly reduce the crosstalk between adjacent twisted pairs of conductors as well. It should be understood that this embodiment is not limited to the illustrated configuration of the inwardly extending projections. It will be obvious to one of ordinary skill in the art that any configuration of the inwardly extending projections can be used so long as at least three longitudinal channels are formed and the inwardly extending projections are sufficiently constructed and arranged to prevent an inadvertent migration of a twisted pair of conductors from one longitudinal channel to another. It is also to be appreciated that for this embodiment of the telecommunications cable of the invention, that the preferred form factor ratio is substantially 1.0.

Figure 5:
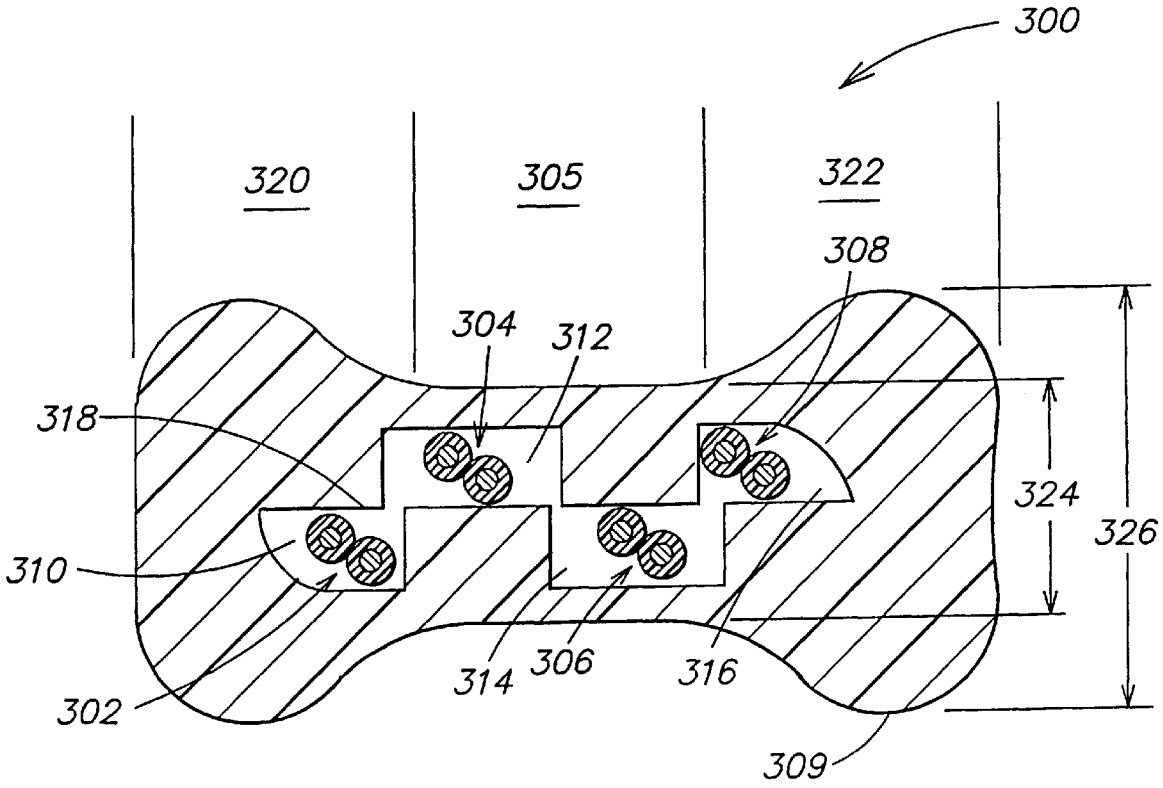
FIG. 5 is a cross-sectional view of a cable of another embodiment of the invention.
Figure 6:
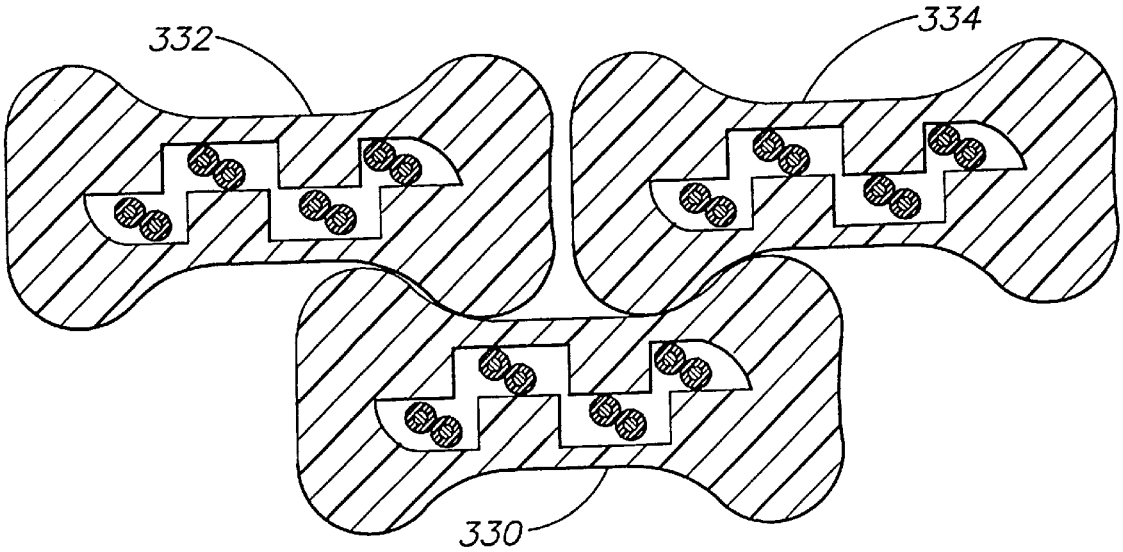
FIG. 6 is a cross sectional view of a plurality of cables of the embodiment shown in FIG. 5 stacked together.

FIG. 5 is another embodiment of the telecommunications cable 300 of the invention. The telecommunications cable 300 has a similar internal structure to the embodiment shown in FIG. 1. In particular, twisted pairs 302, 304, 306 and 308 are each disposed within respective longitudinal channels 310, 312, 314 and 316 formed by inwardly extending projections 318. In addition, the cable jacket 309 includes a medial portion 308 disposed between first and second end portions 320 and 322. In the illustrative embodiment, the medial portion 308 has a first thickness 324 and the first and second end portions have a second thickness 326. This allows an increase in the center-to-center distance between the twisted pairs of conductors in adjacent cables when a plurality of cables 330, 332, 334 are stacked upon one another such as is illustrated, for example, in FIG. 6, thus reducing the level of crosstalk between adjacent cables, herein referred to as "alien crosstalk". Preferably, the first and second end portions 320 and 322 are sized and arranged to fit within the medial portion 305 so that a plurality of cables may be stacked in a lap joint manner as shown in FIG. 6. FIG. 6 illustrates one embodiment of a cable in which similar cables 330, 332, and 334 are stacked in order to decrease the alien crosstalk between adjacent cables. It will be obvious to one of ordinary skill in the art that other configurations of the medial and first and second end portions can be used as well. For example, the first and second end portions can be spherical, polygonal, or square in shape. In addition, the first and second end portions can each have a different thickness.

Figure 7:
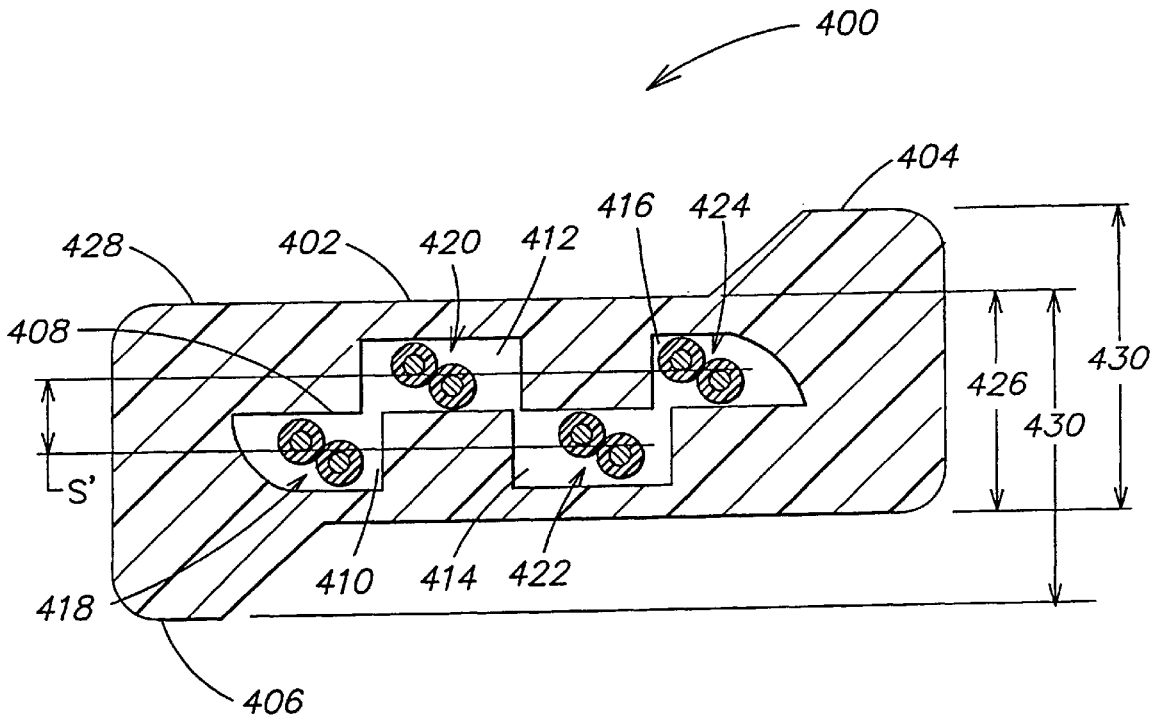
FIG. 7 is a cross-sectional view of a cable of another embodiment of the invention.
Figure 8:
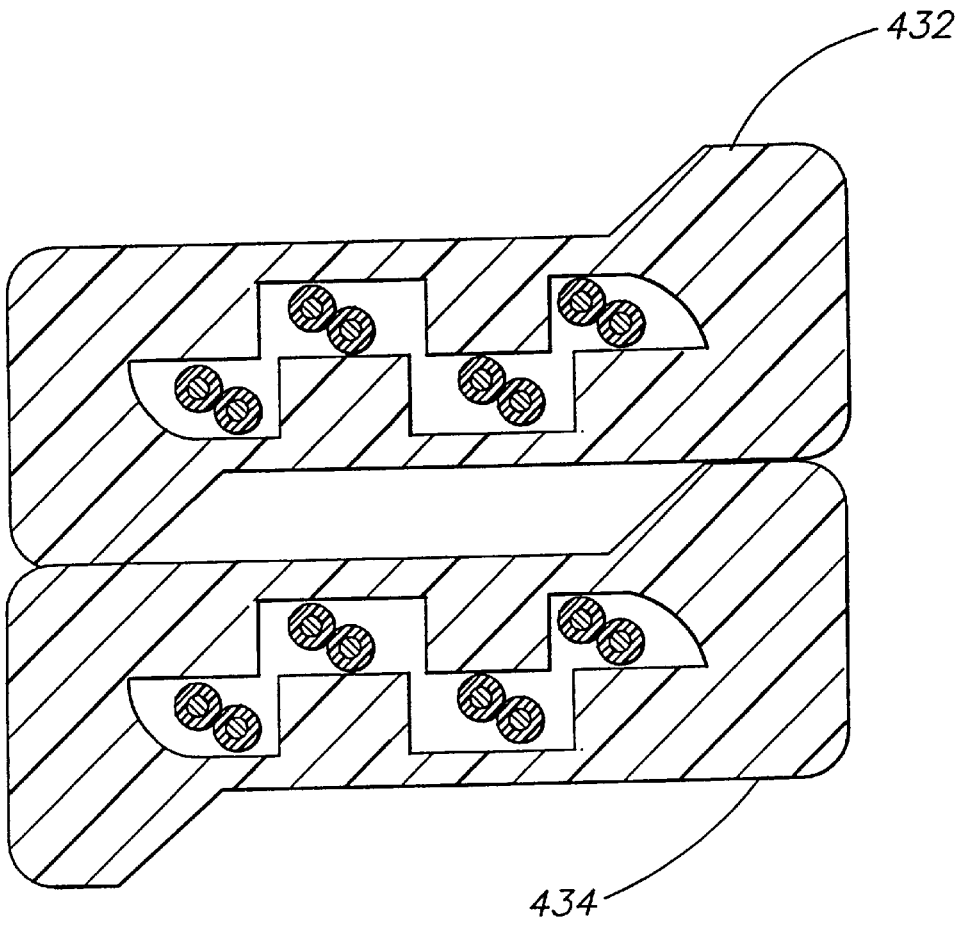
FIG. 8 is a cross-sectional view of a plurality of cables of FIG. 7 stacked together.

FIG. 7 is another embodiment of a telecommunications cable 400 according to the invention. The telecommunications cable 400 has a similar internal structure to the embodiment shown in FIG. 1. In particular, twisted pairs 418, 420, 422 and 424 are each disposed within respective longitudinal channels 410, 412, 414 and 416 formed by inwardly extending projections 408. In addition, the cable jacket 402 includes a medial portion 428 disposed between first and second end portions 404 and 406. In the illustrative embodiment, the medial portion has a first thickness 426 and the first and second end portions have a second thickness 430. In the illustrative embodiment, the first end portion can be a projection outwardly extending from a first outer surface of cable jacket 402. The second end portion 406 can be a projection outwardly extending from a second outer surface of the cable jacket 402 in a direction substantially opposite to the first end portion 404. This allows an increase in the center-to-center distance between the twisted pairs of conductors in adjacent cables, when a plurality of like cables are stacked upon one another such as is illustrated, for example, by cables 432, 434 (illustrated in outline only) in FIG. 8, thereby reducing the level of alien crosstalk between the stacked cables. The first and second end portions 404 and 406 are preferably sized and arranged such that the first end portion 404 has substantially the same height as does the second end portion 406. This is to allow the stacking of the cables as illustrated in FIG. 8. In one embodiment, this leads to a linear stacking arrangement as illustrated in FIG. 8. Although utilizing the end portions 404 and 406, as shown in FIG. 8, does increase the center-to-center distance between adjacent cables, it is to be appreciated that it is important to configure the adjacent cables in an opposite orientation to avoid the inadvertent alignment of the twisted pairs of conductors within the adjacent cables.

Figure 9:
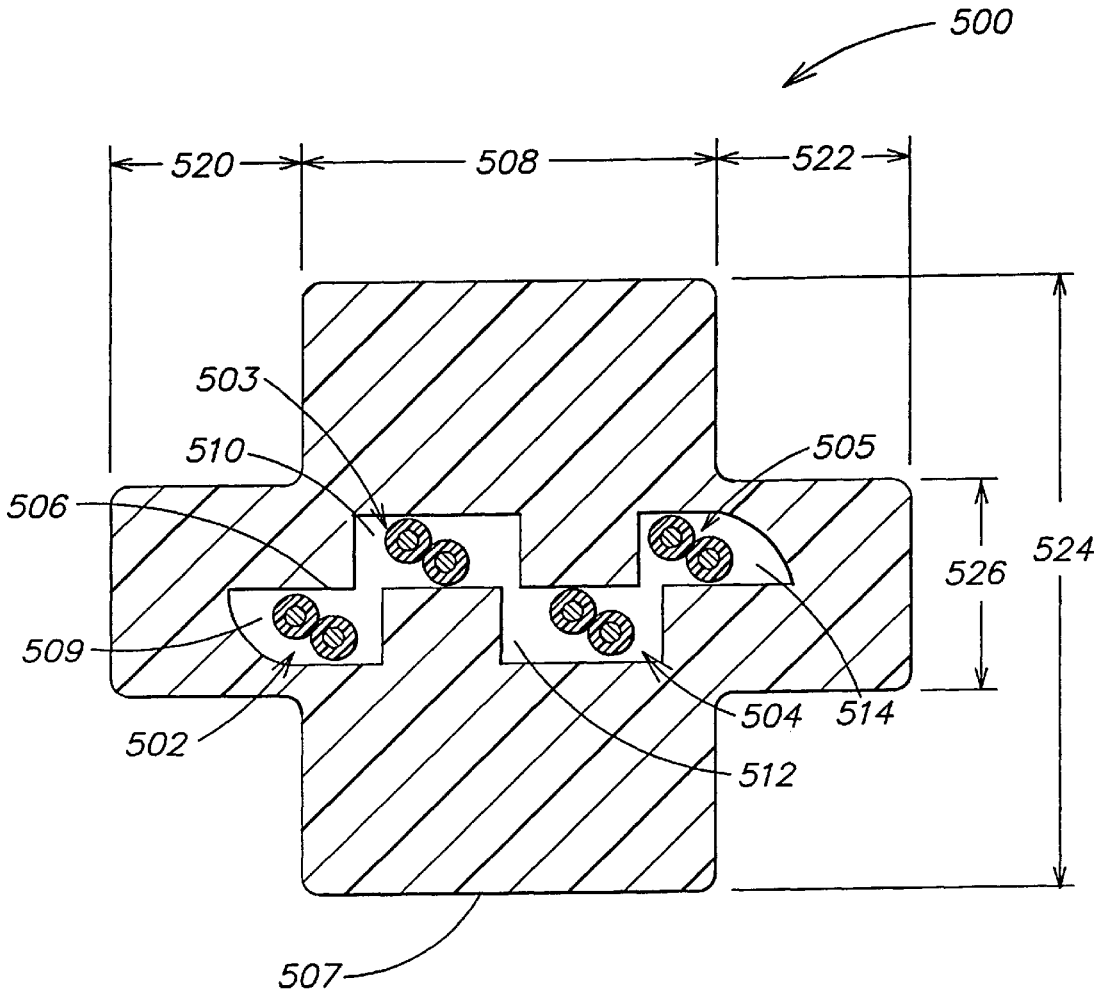
FIG. 9 is a cross-sectional view of another embodiment of the invention.
Figure 10:
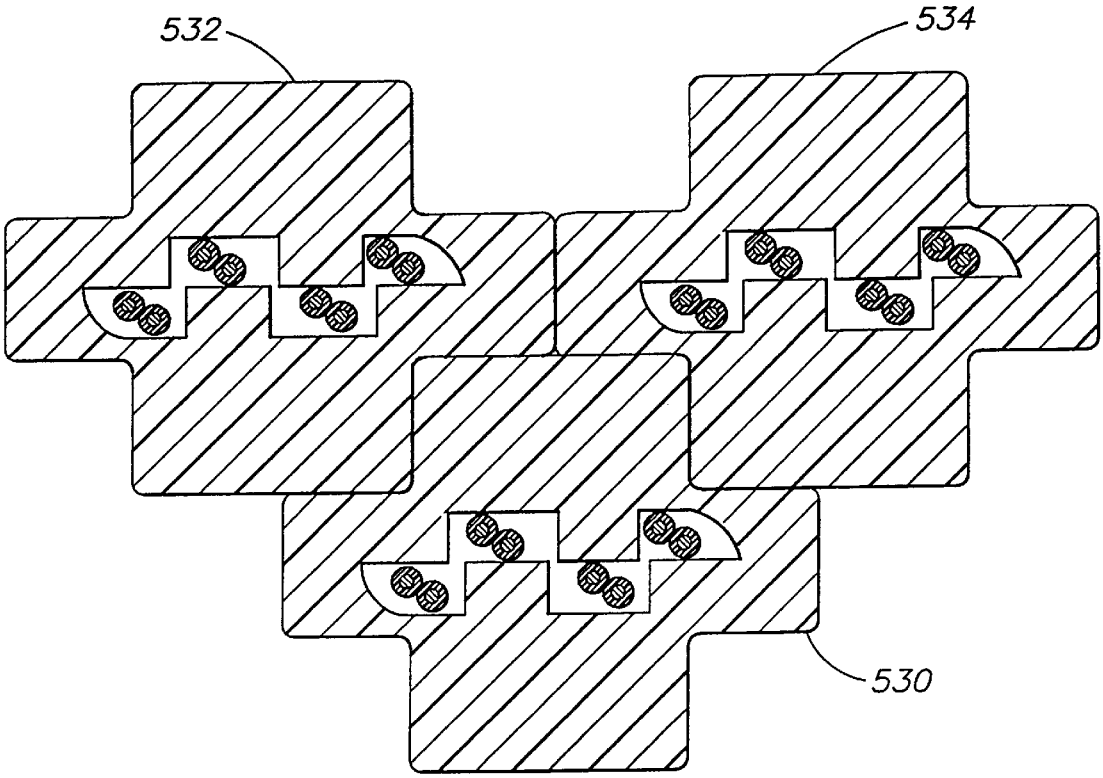
FIG. 10 is a cross-sectional view of a plurality of cables of FIG. 9 stacked together.

FIG. 9 is another embodiment of a telecommunications cable 500 according to the invention. The telecommunications cable 500 has a similar internal structure to the embodiment shown in FIG. 1. In particular, twisted pairs 502, 503, 504 and 505 are each disposed within respective longitudinal channels 509, 510, 512 and 514 formed by inwardly extending projections 506. The cable jacket 507 also includes a medial portion 508 between first and second end regions 520 and 522. In the illustrative embodiment, the medial region 508 has a first thickness 524 and the first and second end regions 520 and 522 have a second thickness 526. This allows an increase in the center-to-center distance between the twisted pairs of conductors between stacked cables 530, 532, 534, as illustrated in FIG. 10, thereby reducing the alien crosstalk. The first and second end regions 520 and 522 are preferably sized and arranged to mate with the medial portion 508 so that a plurality of cable may be stacked in a lap joint manner as shown in FIG. 10. It is to be appreciated that FIG. 10 illustrates one embodiment of a cable in which similar cables 530, 532 and 534 are stacked in order to decrease the alien crosstalk therebetween, and that alternate variations to one of skill in the art as disclosed or as known, are also intended to be within the scope of the invention as claimed.

The outer jacket of any of the embodiments of the telecommunications cable of the invention may be any insulating material that is used within the industry and can be, for example, extruded. In a preferred embodiment, the outer jacket is constructed of a low dielectric constant thermoplastic material that is formed having a thickness of 0.015 inches. It is to be appreciated that, depending on the particular material used, the thickness may be in a range, for example, from 0.012–0.03 inches. If the cable is to be utilized in a plenum application, the outer jacket may be constructed with any one or more of the following compounds: a solid low dielectric constant fluoropolymer, e.g., it may be made from ethylene chlortrifluoroethylene (E-CTFE), fluorinated ethylene propylene (FEP), and low smoke polyvinyl chloride (PVC) in a solid low dielectric constant form. In non-plenum applications a flame retardant polyolefin or similar material may be used.

Figure 11:
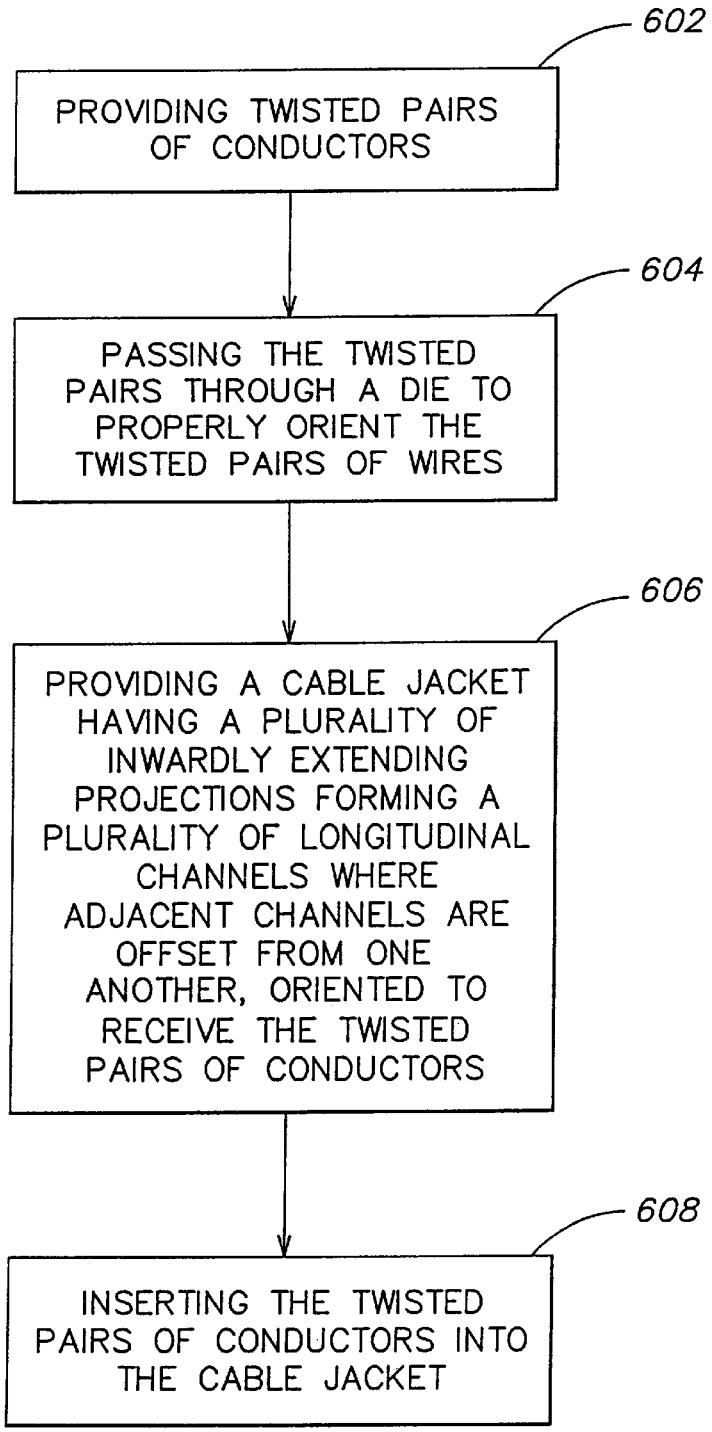
FIG. 11 is a flow chart for manufacturing one embodiment of the present invention.

Referring now to FIG. 11, there is illustrated a method of manufacturing one embodiment of the telecommunications communications cable according to the present invention. In step 602, a plurality of twisted pairs of conductors are provided. In step 604, the twisted pairs of insulated conductors are passed through a die to align them in a predetermined spatial relationship. In step 606, a cable jacket is provided, having a plurality of inwardly extending projections forming a plurality of longitudinal channels in which adjacent longitudinal channels are offset from one another. In one embodiment, the cable jacket can be provided via an extrusion process through an extrusion head. In step 608, the properly oriented twisted pair of insulated conductors are inserted into the provided cable jacket. In one embodiment, the twisted pairs of insulated conductors can be inserted into the cable jacket by passing the twisted pairs through the extrusion head in the center of the extruded cable jacket.

It is also to be appreciated that the cable jacket of the invention can be extruded so that at least some or all of opposing edges of ends of the inwardly extending projections are tacked together, as described above, to isolate at least some or all of the longitudinally extending channels. In addition, it is to be appreciated that the cable jacket can be extruded with any of the above-described configurations to keep the stacked cables at an increased distance such as, for example, the outwardly extending projection.

Having thus described certain embodiments of the present invention, various alterations, modifications and improvements will be apparent to those of ordinary skill in the art. Such alterations, variations and improvements are intended to be within the spirit and scope of the present invention. Accordingly, the foregoing description is by way of example and is not intended to be limiting. The present invention is limited only as defined in the following claims and the equivalents thereto.

What is claimed is:

1. A telecommunications cable comprising:

a cable jacket having a plurality of inwardly extending projections;

the plurality of inwardly extending projections defining first, second, third and fourth longitudinal channels; corresponding transmission media disposed within the first, second, third and fourth longitudinal channels;

wherein opposing edges of some of the plurality of inwardly extending projections are tacked together to isolate some of the longitudinal channels from each other; and wherein the corresponding transmission media within the first and third channels are at approximately a same point with respect to a reference line that transverses the cable, and wherein the second and fourth longitudinal channels are spaced apart from the reference line by the plurality of inwardly extending projections so that a distance is increased between the transmission media disposed within the second and fourth longitudinal channels and the transmission media disposed within the first and third longitudinal channels.

2. The telecommunications cable as claimed in claim 1, wherein each of the corresponding transmission media is a twisted pair of insulated conductors.

3. The telecommunications cable as claimed in claim 1, wherein the fourth longitudinal channel is spaced apart from the reference line by one of the plurality of inwardly extending projections at substantially the same distance as the second longitudinal channel.

4. The telecommunications cable as claimed in claim 1, wherein opposing edges of each of the plurality of inwardly extending projections are tacked together for sealing each of the longitudinal channels from each other.

5. The telecommunications cable as claimed in claim 1, wherein a form factor ratio of a width to a height of the telecommunication cable is between 1.25 and 2.5.

6. The telecommunications cable as claimed in claim 5, wherein the form factor ratio of the width to the height of the telecommunications cable is between 1.5 and 2.0.

7. The telecommunications cable as claimed in claim 1, wherein the cable jacket further includes a first portion having a first thickness disposed between two end portions, each end portion having a second thickness.

8. The telecommunications cable as claimed in claim 7, wherein the first thickness is less than the second thickness.

9. The telecommunications cable as claimed in claim 7, wherein the second thickness is less than the first thickness.

10. The telecommunications cable as claimed in claim 1, wherein the cable jacket further comprises a first outward projection extending in a first direction and a second outward projection extending in a second direction.

11. The telecommunications cable as claimed in claim 10, wherein the cable jacket has a first surface and an opposing second surface, and wherein the first outward projection is disposed upon the first surface and the second outward projection is disposed upon the second opposing surface.

12. The telecommunications cable as claimed in claim 10, wherein the first and second directions are substantially opposite.

13. The telecommunications cable as claimed in claim 1, wherein the cable jacket is substantially circular in cross section.

14. The telecommunications cable as claimed in claim 1, wherein the cable jacket is substantially oval in cross section.

15. The telecommunications cable as claimed in claim 1, wherein the cable jacket is a plenum rated material that contributes to the overall cable passing the Underwriters Laboratories 910 test.

16. The telecommunications cable as claimed in claim 1, wherein the cable jacket is a fluoropolymer.

17. The telecommunications cable as claimed in claim 1, wherein the cable jacket has a base material of polyvinyl chloride.

18. The telecommunications cable as claimed in claim 1, wherein the cable jacket is formed principally of ethylene chlortrifluoroethylene.

19. The telecommunications cable as claimed in claim 1, wherein the cable jacket is formed principally of fluorinated ethylene propylene.

20. The telecommunications cable as claimed in claim 1, wherein the cable jacket is a non-plenum rated material.

21. The telecommunications cable as claimed in claim 20, wherein the non-plenum rated cable jacket is a low smoke PVC material.

22. A telecommunications cable comprising:

a cable jacket having a plurality of inwardly extending projections;

the plurality of inwardly extending projections defining first and second pluralities of substantially parallel longitudinal channels extending along a length of the telecommunications cable;

a corresponding transmission media disposed within each of the first and second pluralities of longitudinal channels;

the first plurality of substantially parallel longitudinal channels being at approximately a same point with respect to a reference line that transverses the cable;

the second plurality of substantially parallel longitudinal channels being spaced apart from the reference line by some of the plurality of inwardly extending projections so that the corresponding transmission media within the first plurality of channels is spaced apart from the corresponding transmission media in the second plurality of channels; and wherein opposing edges of some of the plurality of inwardly extending projections are tacked together to isolate some of the longitudinal channels from each other.

23. The telecommunications cable as claimed in claim 22, wherein each of the corresponding transmission media is a twisted pair of insulated conductors.

24. The telecommunications cable as claimed in claim 22, wherein opposing edges of each of the plurality of inwardly extending projections are tacked together for sealing each of the longitudinal channels from each other.

25. The telecommunications cable as claimed in claim 22, wherein a form factor ratio of a width to a height of the telecommunication cable is between 1.25 and 2.5.

26. The telecommunications cable as claimed in claim 25, wherein the form factor ratio of the width to the height of the telecommunications cable is between 1.5 and 2.0.

27. The telecommunications cable as claimed in claim 22, wherein the cable jacket further includes a first portion having a first thickness disposed between two end portions each having a second thickness.

28. The telecommunications cable as claimed in claim 27, wherein the first thickness is less than the second thickness.

29. The telecommunications cable as claimed in claim 27, wherein the second thickness is less than the first thickness.

30. The telecommunications cable as claimed in claim 27, wherein the cable jacket further comprises a first outward projection extending in a first direction and a second outward projection extending in a second direction.

31. The telecommunications cable as claimed in claim 30, wherein the cable jacket has a first surface and an opposing second surface, and wherein the first outward projection is disposed upon the first surface and the second outward projection is disposed upon the opposing second surface.

32. The telecommunications cable as claimed in claim 30, wherein the first and second directions are substantially opposite.

33. The telecommunications cable as claimed in claim 22, wherein the cable jacket is substantially circular in cross section.

34. The telecommunications cable as claimed in claim 22, wherein the cable jacket is substantially oval in cross section.

35. The telecommunications cable as claimed in claim 22, wherein the cable jacket is a plenum rated material that contributes to the overall cable passing the Underwriters Laboratories 910 test.

36. The telecommunications cable as claimed in claim 22, wherein the cable jacket is a fluoropolymer.

37. The telecommunications cable as claimed in claim 22, wherein the cable jacket has a base material of polyvinyl chloride.

38. The telecommunications cable as claimed in claim 22, wherein the cable jacket is formed principally of ethylene chlortrifluoroethylene.

39. The telecommunications cable as claimed in claim 22, wherein the cable jacket is formed principally of fluorinated ethylene propylene.

40. The telecommunications cable as claimed in claim 22, wherein the cable jacket is a non-plenum rated material.

41. The telecommunications cable as claimed in claim 40, wherein the non-plenum rated cable jacket is a low smoke PVC material.

* * * * *